US008191639B2

(12) United States Patent
Howlett et al.

(10) Patent No.: US 8,191,639 B2
(45) Date of Patent: Jun. 5, 2012

(54) DOWNHOLE SWIVEL SUB

(75) Inventors: Paul Howlett, Aberdeen (GB); James Bain, Angus (GB)

(73) Assignee: Tercel Oilfield Products UK Limited, Aberdeen (GB)

( * ) Notice: Subject to any disclaimer, the term of this patent is extended or adjusted under 35 U.S.C. 154(b) by 58 days.

(21) Appl. No.: 11/911,049

(22) PCT Filed: Apr. 18, 2006

(86) PCT No.: PCT/GB2006/001396
§ 371 (c)(1),
(2), (4) Date: May 13, 2008

(87) PCT Pub. No.: WO2006/109090
PCT Pub. Date: Oct. 19, 2006

(65) Prior Publication Data

US 2008/0236841 A1 Oct. 2, 2008

(30) Foreign Application Priority Data

Apr. 15, 2005 (GB) ..... 0507639.3

(51) Int. Cl.
*E21B 23/04* (2006.01)

(52) U.S. Cl. ..... 166/381; 166/237; 192/69.9

(58) Field of Classification Search ..... 166/381, 166/383, 237, 240, 117.7, 242.1; 175/320, 175/106; 464/18, 20, 21; 192/69.9, 69.91
See application file for complete search history.

(56) References Cited

U.S. PATENT DOCUMENTS 1,862,188 A * 6/1932 Legge ..... 192/48.6
1,883,071 A * 10/1932 Stone ..... 166/194
2,344,121 A * 3/1944 Bassinger ..... 166/334.2
2,401,179 A * 5/1946 Orr ..... 192/69.9
3,100,538 A 8/1963 Sanders
3,136,367 A * 6/1964 Wright et al. ..... 166/208
3,285,345 A 11/1966 Solum
3,446,280 A * 5/1969 Nutter ..... 166/152
3,552,492 A * 1/1971 Mullins ..... 166/237
3,608,634 A * 9/1971 Cochran ..... 166/208
3,746,090 A * 7/1973 Read et al. ..... 166/134
4,064,953 A 12/1977 Collins
4,295,535 A 10/1981 Crase et al.
4,441,560 A * 4/1984 Baugh et al. ..... 166/382
4,681,159 A * 7/1987 Allwin et al. ..... 166/124
4,828,037 A * 5/1989 Lindsey et al. ..... 166/382

(Continued)

FOREIGN PATENT DOCUMENTS

GB 2 287 731 A 9/1995

(Continued)

*Primary Examiner* — David Bagnell
*Assistant Examiner* — Blake Michener
(74) *Attorney, Agent, or Firm* — Sughrue Mion, PLLC

(57) ABSTRACT

The present invention provides a swivel sub for connection in a work string between a workstring and a downhole apparatus. The swivel sub includes a first substantially cylindrical body, including a sleeve portion having one or more teeth and a second substantially cylindrical body being partially located within the sleeve portion. The bodies are arranged to rotate relative to each other. The swivel sub also includes a sliding sleeve, having one or more teeth arranged mutually engage with the first teeth is axially moveable between disengaged and engaged positions, in one embodiment by a pressure differential being created in the sub. Further, the present invention provides methods for of running the tool, with particular application to setting and hanging of liners and screens.

5 Claims, 2 Drawing Sheets

U.S. PATENT DOCUMENTS

| | | | | | |
|---|---|---|---|---|---|
| 4,834,185 | A | * | 5/1989 | Braddick | 166/382 |
| 4,844,161 | A | * | 7/1989 | Rankin et al. | 166/250.17 |
| 5,048,612 | A | * | 9/1991 | Cochran | 166/382 |
| 5,323,852 | A | | 6/1994 | Cornette et al. | |
| 5,394,938 | A | | 3/1995 | Cornette et al. | |
| 5,642,782 | A | | 7/1997 | Grimshaw et al. | |
| 5,697,768 | A | * | 12/1997 | Mills | 417/365 |
| 5,996,712 | A | | 12/1999 | Boyd | |
| 6,082,457 | A | | 7/2000 | Best et al. | |
| 6,129,160 | A | | 10/2000 | Williams et al. | |
| 6,241,018 | B1 | * | 6/2001 | Eriksen | 166/215 |
| 6,241,032 | B1 | | 6/2001 | Falgout, Sr. | |
| 6,244,345 | B1 | | 6/2001 | Helms | |
| 6,378,630 | B1 | | 4/2002 | Ritorto et al. | |
| 6,516,878 | B1 | * | 2/2003 | McGarian et al. | 166/242.7 |
| 6,915,865 | B2 | * | 7/2005 | Boyd | 175/321 |
| 7,036,580 | B2 | * | 5/2006 | McGarian et al. | 166/117.7 |
| 7,178,611 | B2 | * | 2/2007 | Zupanick | 175/75 |
| 7,506,704 | B2 | * | 3/2009 | McGarian et al. | 175/321 |
| 2004/0007355 | A1 | | 1/2004 | Hern et al. | |
| 2004/0094309 | A1 | * | 5/2004 | Maguire | 166/381 |
| 2004/0144567 | A1 | * | 7/2004 | Boyd | 175/57 |
| 2007/0246217 | A1 | * | 10/2007 | Tulloch et al. | 166/311 |

FOREIGN PATENT DOCUMENTS

| | | | | |
|---|---|---|---|---|
| GB | 2378197 | A | * | 2/2003 |
| GB | 2 381 806 | A | | 5/2003 |
| WO | 93/10326 | A1 | | 5/1993 |

* cited by examiner

DOWNHOLE SWIVEL SUB

CROSS REFERENCE TO RELATED APPLICATIONS

This application is a National Stage of International Application No. PCT/GB2006/001396 filed on Apr. 18, 2006, claiming priority based on British Patent Application No. 0507639.3, filed Apr. 15, 2005, the contents of all of which are incorporated herein by reference in their entirety.

The present invention relates to downhole tools for use in the oil and gas industry and, in particular, to a swivel sub suitable for use when running delicate screens or liners into a wellbore, or in directional drilling applications.

During completion of a oil or gas well, sand control screens or liners are located in the wellbore. Typically the screens and liners are lowered into the wellbore on a workstring, but there is often insufficient workstring down weight available to the driller to put the screens into the well without rotating the string to break the friction. Applying too much downhole weight can over-compress the pipe below, thereby causing damage. It is advantageous to rotate the workstring attached to the screens or liners when inserting in high angle/ERD (extended reach drilling) or tortuous wells due to the fact that the associated drag of the friction is reduced in the workstring, making it easier to observe and apply the necessary measured down weight to aid getting sand screens or liners to the planned depth. However, it is often not desirable to rotate the screens or liners (perhaps with delicate accessories) for fear of damage. For example, if the screen or liner sticks, buckling can occur as a result of the applied torque.

In directional drilling applications, using downhole drilling motors or rotary steerable tools it will often be necessary to selectively engage or disengage the main drill string with drill bit to allow rotation independent of the main drill string at times, and rotation with the drill string at others.

U.S. Pat. No. 5,394,938 describes a gravel pack screen wherein a fluid permeable base pipe has a screen jacket rotatably mounted thereon, so that the base pipe or drill-pipe string can be rotated without imparting torque to the screen jacket. Such an arrangement advantageously prevents torque being applied to the screen, but has the disadvantage that for certain applications it is useful to be able to selectively impart full rotation to the whole drill-pipe string, including the screens and liners. For instance, it may be desirable to have an ability to free a screen from a running tool by releasing the running tool from the screen and rotating the running tool, to prevent an unnecessary upward movement of the screen during deployment.

U.S. Pat. No. 5,323,852 discloses an auger gravel pack screen connected to a drill-pipe string which includes a torque limiting device to limit the maximum torque exerted on the screen. While this arrangement prevents damage to the screen from the over application of torque, the device does not provide any selective application of torque, as may be required for the release of running tools, etc.

U.S. Pat. No. 6,244,345 describes a lockable swivel apparatus located above the rotary table, which allows an operator to selectively rotate the drill string while a wireline can be manipulated below. One disadvantage of this swivel apparatus is that in order to unlock or disengage the swivel, so that the parts can be relatively rotated, weight must be set down on the drill string. This would not be desirable in the use of sand screens or liners, as the act of setting down weight on the sand screen or liner may cause it to buckle and become damaged.

U.S. Pat. No. 6,516,878 describes a tension swivel sub used for cutting and removing sections of a wellbore casing. A compression spring maintains a spear located below a cutter into rotational engagement with the string, and the spear is set against the casing below the cutter. Tension is applied to overcome the compression spring and disengage the spear from the string, so that the string above the spear can be rotated. One disadvantage of these tools is that they cannot be used on run in, as the drill-pipe string below the sub must be held in place to disengage the drill-pipe string and allow selective rotation of the cutter above.

It is an object of the invention to provide a swivel sub that overcomes at least one drawback or disadvantage of prior art swivel subs.

It is an object of at least one embodiment the present invention to provide a swivel sub which allows the rotation of a drill-pipe string above the sub to be selectively transmitted through the sub to downhole apparatus, such as a screen, liner assembly, or drill bit below.

It is a further object of at least one embodiment of the present invention to provide a swivel sub wherein relative rotation between the drill-pipe string above the sub and downhole apparatus below the sub, such as a screen, liner assembly or drill bit, can be achieved without compression or tension at the sub.

It is a further object of at least one aspect of the invention to provide a downhole swivel sub that meets the objects above.

Additional aims and objects of the invention will become apparent from the following description.

According to a first aspect of the present invention, there is provided a swivel sub for connection in a work string between a workstring and a downhole apparatus, the sub comprising a first substantially cylindrical body, including a sleeve portion having one or more first teeth arranged thereon; a second substantially cylindrical body being partially located within the sleeve portion and the bodies being arranged to rotate relative to each other; a sliding sleeve, including one or more second teeth arranged thereon, to mutually engage with the first teeth; the sliding sleeve being axially moveable between a first position, wherein the first and second teeth are disengaged and a second position, wherein the first and second teeth are engaged; and means to engage the sliding sleeve with the second cylindrical body.

The sliding sleeve may be operable to be engaged with the second cylindrical body, or may be keyed with the second cylindrical body.

Thus, with the sliding sleeve locked to the second body, the sub may be arranged so that the teeth are locked in either the engaged or disengaged position.

Preferably, the sliding sleeve is moved by virtue of a pressure differential in the sub. The pressure differential may be created by dropping a ball into a ball seat of a downhole apparatus, such as a screen, liner assembly, or drill bit located below the sub.

Alternatively, the sliding sleeve may be operated by a hydraulic system. Optionally, the sliding sleeve may be moved by a mechanical system.

In a first embodiment, the first cylindrical body is a top sub, including means for connecting the top sub to a workstring. The second cylindrical body may be an inner mandrel including means for connecting the inner mandrel, at a lower end, to a downhole apparatus. The downhole apparatus may be apparatus for running or hanging a liner or screen. Alternatively, the downhole apparatus is directional drilling apparatus.

Preferably, the first and second bodies include central bores therethrough, such that the sub has a central bore running axially therethrough. This arrangement allows wireline and other tools to be located through the sub, and also allows for circulation fluids, etc., through the sub and the drill-pipe string, if desired.

Preferably a bearing sleeve is located between the first and second bodies to provide smooth rotation relative to each other.

Preferably, the sub includes at least one shear pin which connects the sliding sleeve to the second cylindrical body.

More preferably, the sliding sleeve includes at least one locking dog. In this way, an initial pressure differential will cause the shear pin to shear and the sliding sleeve will move, such that the first and second teeth move axially with respect to each other. The locking dog can then engage the sliding sleeve with the second cylindrical body to lock the sub in either of the first or second positions.

In a preferred embodiment, the sub is initially set in the first position, wherein the sliding sleeve is held to the second cylindrical body with the first and second teeth disengaged. In this arrangement, the second cylindrical body can rotate with respect to the first cylindrical body. If the first cylindrical body is connected to a drill-pipe string, this arrangement allows the drill-pipe string to be rotated while apparatus attached to the second cylindrical body will be held stationary. By the application of differential pressure, the shear pin may shear and the sliding sleeve will move axially over the second body until the locking dog engages the sliding sleeve in a second position. The second position has the first and second teeth engaged, and thus rotation of the drill-pipe string and the first cylindrical body will cause the second cylindrical body to rotate with the first cylindrical body.

Optionally, a drop ball seat may be located within the sub, in order to provide means for creating a pressure differential in the sub.

Preferably, a spring is located between the first cylindrical body and the sliding sleeve. In this way, the sleeve can be biased toward the first or the second position.

Advantageously, the sliding sleeve may incorporate an index sleeve. In this way, a pin and groove arrangement can allow the sliding sleeve to selectively rotate around the second body, and move axially so that the sub can be selectively engaged or disengaged any number of times.

According to a second aspect of the present invention, there is provided a method of running a downhole apparatus into a wellbore, the method comprising the steps of:

(a) locating a swivel sub between a workstring and a downhole apparatus;
(b) running the workstring into the wellbore while rotating the workstring;
(c) creating a pressure differential in the swivel sub to switch the sub between a first position, in which the workstring rotates relative to the downhole apparatus and a second position in which the workstring and at least a portion of the downhole apparatus rotate together.

The method may comprise the additional steps of rotating the workstring with the swivel sub in the first position such that the workstring rotates relative to the downhole apparatus.

The method may comprise the additional step of rotating the workstring with the swivel sub in its second position such that the workstring and at least a portion of the downhole apparatus rotate together.

The method may include the step of dropping a ball through the workstring to land on a ball seat and create the pressure differential.

The method may further include the step of locking the sub in the second position.

The method may further include the step of creating a further pressure differential to relocate the sub into the first position and rotating the workstring relative to the downhole apparatus.

The downhole apparatus may comprise a running or setting tool. Preferably, the portion which rotates with the workstring is the running or setting tool.

In one embodiment, the downhole apparatus comprises a running or setting tool for a liner or screen.

Alternatively, the downhole apparatus comprises directional drilling equipment.

According to a third aspect of the invention, there is provided a method of running a downhole apparatus into a wellbore, the method comprising the steps of:

(a) locating a swivel sub between a workstring and a downhole apparatus;
(b) running the workstring into the wellbore while rotating the workstring;
(c) creating a pressure differential in the swivel sub to switch the sub between a first position, in which the workstring rotates relative to the downhole apparatus and a second position in which the workstring and at least a portion of the downhole apparatus rotate together.

The method may comprise the additional step of rotating the workstring with the swivel sub in the first position such that the workstring rotates relative to the downhole apparatus.

The method may comprise the additional step of rotating the workstring with the swivel sub in its second position such that the workstring and at least a portion of the downhole apparatus rotate together.

The method may include the step of dropping a ball through the drill-pipe string in order to create the pressure differential.

Further, the method may include the step of creating a further differential pressure to switch the sub back to the first position and rotating the drill-pipe string and downhole apparatus together.

Preferably, the steps can be repeated any number of times, so that the sub may be cycled between the first and second positions.

According to a fourth aspect of the invention there is provided a method of running downhole apparatus into a wellbore, the method comprising the steps of:

(a) locating a swivel sub between a workstring and the downhole apparatus;
(b) rotating the workstring with the swivel sub in an engaged position, such that the workstring rotates with the downhole apparatus;
(c) running the apparatus on the workstring into a wellbore, while rotating the workstring and the apparatus;
(d) creating a pressure differential in the swivel sub, such that the sub switches to a disengaged position, such that the workstring can be rotated relative to the downhole apparatus.

The method may comprise the additional step of rotating the workstring relative to the downhole apparatus.

The method may comprise the additional steps of creating a further differential pressure to switch the sub back to the engaged position, and; rotating the workstring and downhole apparatus together.

According to a fifth aspect of the present invention, there is provided a swivel sub for connection in a work string between a drill-pipe string and a screen or liner assembly, the sub comprising a first substantially cylindrical body, including a sleeve portion having one or more first teeth arranged on a surface thereof; a second substantially cylindrical body being partially located within the sleeve portion and the bodies being arranged to rotate relative to each other; a sliding sleeve, including one or more second teeth arranged on a surface thereof, to mutually engage with the first teeth; the sliding sleeve being axially moveable between a first position, wherein the first and second teeth are disengaged and a second position, wherein the first and second teeth are engaged; and means to lock the sliding sleeve to the second cylindrical body.

According to a sixth aspect of the invention there is provided a method of running a screen or liner into a wellbore, the method comprising the steps:

(a) locating a swivel sub between a drill-pipe string and a liner or screen assembly;
(b) rotating the drill-pipe string with the swivel sub in a first position, such that the drill-pipe string rotates relative to the assembly;
(c) running the drill-pipe string into the wellbore while rotating the drill-pipe string;
(d) creating a pressure differential in the swivel sub to switch the sub into a second position, such that the drill-pipe string and at least a portion of the assembly rotate together; and
(e) rotating the drill-pipe string and the portion of the assembly.

According to a seventh aspect of the present invention, there is provided a method of running downhole apparatus into a wellbore, the method comprising:

(a) locating a swivel sub between a drill-pipe string and the downhole apparatus;
(b) rotating the drill-pipe string with the swivel sub in a first position, such that the drill-pipe string rotates with the downhole apparatus;
(c) running the apparatus on the drill-pipe string into a wellbore, while rotating the drill-pipe string and the apparatus;
(d) creating a pressure differential in the swivel sub, such that the sub switches to a second position, such that the drill-pipe string can be rotated relative to the downhole apparatus; and
(e) rotating the drill-pipe string relative to the downhole apparatus.

Preferred embodiments of the fifth to seventh aspects of the invention may include features of the embodiments of the first to fourth aspects of the invention.

Embodiments of the present invention will now be described by way of example only, with reference to the following drawings, of which:

Figure 1:
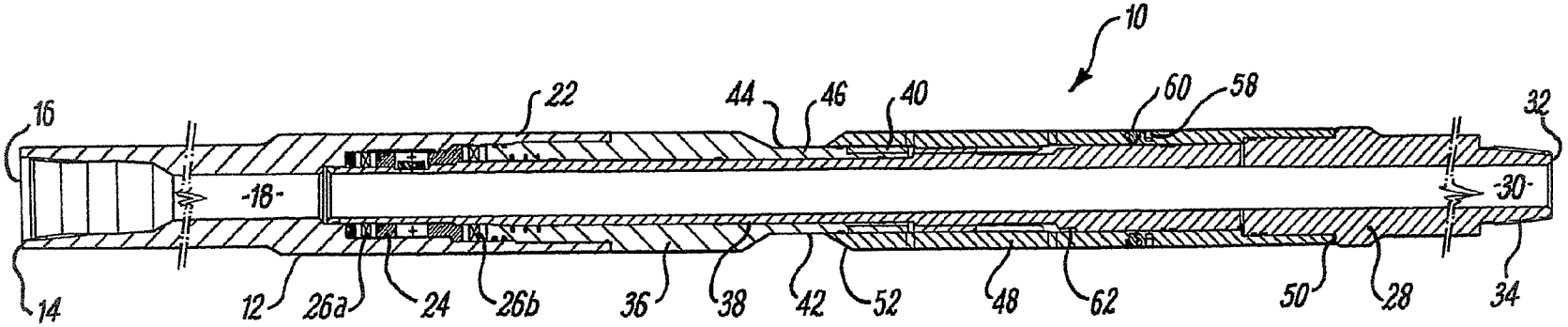
FIG. 1 is a cross-sectional view through a swivel sub according to a first embodiment of the present invention, in an unlocked configuration.

Reference is initially made to FIG. 1 of the drawings, which illustrates a swivel sub, generally indicated by reference numeral 10, according to the first embodiment of the present invention. Sub 10 comprises a first cylindrical body 12 having at an upper end 14, a box section 16 for connecting the body 12 to a drill-pipe string (not shown). The body 12 includes a bore 18 therethrough and at a lower end 20 there is provided a sleeve 22 extending from the body 12. Located within the sleeve 22 is a bearing sleeve 24 which includes bearings 26*a,b* to provide a rotational coupling to anything placed adjacent to the bearing sleeve 24.

Figure 3:
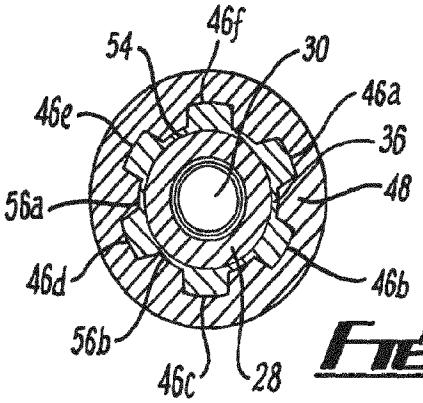
FIG. 3 is a sectional view through the Line A-A of FIG. 2.

Located within the bearing sleeve 24 and thus rotationally coupled to it, is an inner mandrel 28. Inner mandrel 28 is a cylindrical body having a central bore 30 located therethrough. At an upper end 32, distal to the bearing sleeve 24, is a pin section 34 for connecting the sub to a downhole apparatus (not shown). Attached to the sleeve 22 is a locking sleeve 36 which may form part thereof. The locking sleeve 36 abuts an outer surface 38 of the mandrel 28. Locking sleeve 36 is preferably screwed to the sleeve 22 and has at an upper end 40 a narrowed portion 42 which has, on its outer surface 44, six teeth 46*a-f*, as illustrated in FIG. 3.

Located on the outer surface 38 of the mandrel 28 is a sliding sleeve 48. The sliding sleeve 48 is arranged to travel longitudinally on the inner mandrel 28. Its passage is restricted by an abutment face 50 on the mandrel 28 and by engagement with the teeth 46 on the locking sleeve 36. At an upper end 52 of the sliding sleeve, arranged on an inner surface 54 thereof, are located six teeth 56*a-f*, as illustrated in FIG. 3. Teeth 46, 56 are sized so that they can engage with each other when axially brought together.

Located around the sliding sleeve 48 are six shear pins 58. The shear pins 58 are equidistantly spaced around the sleeve 48, passing through apertures in the sleeve 48 into the inner mandrel 28. Thus, the sliding sleeve 48 is fixed to the inner mandrel 28.

In a first configuration, as shown in FIG. 1, the shear pins 58 fix the sliding sleeve 48 to the mandrel 28. The sliding sleeve 48 is located against the abutment face 50. The teeth 46, 56 are disengaged with the upper end 52 of sleeve 48 being clear of the teeth 46 on the locking sleeve 36 though there is still provided a small overlap to assist in positioning the sleeves on the sub 10. Also located on the sleeve 48 is a locking dog 60. This is a sprung pin which is biased towards the inner mandrel 28. In this embodiment, the dog 60 is compressed.

Reference is now made to FIG. 3 of the drawings, which illustrates the sub 10 of FIG. 1, in a second configuration. In FIG. 3, shear pins 58 have been sheared and the sliding sleeve 48 has been moved up so that the teeth 46, 56 are completely engaged. The locking dog 60 is now located over a recess 62 on the inner mandrel 28. The dog 60 expands to locate a pin into the recess 62. With the pin located in the recess 62, the sliding sleeve 48 is prevented from movement. The locking sleeve 36, through engagement with the sliding sleeve 48, is now locked to the inner mandrel 28.

In use, sub 10 is connected to a drill-pipe string via the box section 16. A liner or screen is attached via a liner hanging tool or running tool onto the pin section 34 at the lower end 32 of the sub 10. The sliding sleeve 48 is arranged in the configuration shown in FIG. 1, that is the sleeve is pulled back against the abutment face 50 and the shear pins 58 are mounted through the sleeve 48 into the inner mandrel 28. In this configuration the sub is unlocked and the teeth 46, 56 are clear of each other and disengaged. The inner mandrel 28 is now only connected to the top sub 10 via the bearing sleeve 24. In this way, the body 12 and the mandrel 28 can rotate independently of each other.

When run in a wellbore, the drill-pipe string at the upper end 14 of the sub 10 can be rotated, while the liner connected to the inner mandrel 28 can remain stationary. No torque will be imparted onto the liner, as it is all borne by the bearing sleeve 24. Further rotation of the drill-pipe string above the sub is achieved without tension or compression on the sub. This means that once the screen or liner is at total depth (TD), the drill string can continue to be rotated during circulation to aid in hole displacement, and cuttings or debris removal without fear of imparting rotation or torque below.

If rotation of the liner hanger or setting tool is required, a differential pressure is induced within the sub 10. This can be done by dropping a ball from the surface of the wellbore through the bores 18 and 30 of the sub, and into a ball seat. The ball seat may be mounted in the inner mandrel 28 or, alternatively, it may be located in the liner hanging tool or running tool mounted on the pin 34 of the inner mandrel 28. On passing a ball into the bore 30, fluid can be circulated through the bore 30 to induce a pressure build up within the sub 10, pressure outside the sub on the sliding sleeve 48 will induce movement in the sleeve 48. Sufficient force of the movement will break the shear pins 58, allowing the sleeve 48 to move.

Sleeve 48 will move towards the upper end 14 of the sub 10. As the sleeve 48 moves, the teeth 56 pass between the teeth 46 on the locking sleeve 36. The engagement of the teeth 46,56 causes the sleeves 36, 48 to couple until the locking pin 60 reaches the recess 62, whereupon movement of the sliding sleeve 48 is then prevented. In this position, teeth 46, 56 are fully engaged and the sliding sleeve 48 is locked to the inner mandrel 28. Torque now imparted from the drill-pipe string will cause rotation of the body 12 and the locking sleeve 36. By virtue of the engagement of the teeth 46,56, the sliding sleeve 48 will be forced to rotate with the body 12. As the sliding sleeve 48 is locked to the inner mandrel 28, the inner mandrel will now also rotate with the body 12, thus the entire sub 10 will rotate with the drill string.

This feature can be considered an emergency device that can be used to help screen deployment running tools that perhaps will not release easily. Having an ability to rotate the running tools to free them from the running assembly, may prevent the unnecessary upward movement of the screens or liner once deployed. The lock-up feature could also be necessary if hydraulically tools were required to be released by their emergency release features, i.e., through left-hand rotation, as is the case for some liner hanger tools used for screen deployments.

In the embodiment shown, a predetermined differential pressure at the sub of around 2,500 psi is required to disengage the sliding sleeve and cause movement into the locked position. The differential pressure can be achieved by pushing up against a ball on a shearable ball seat. It could also be applied by running a retrievable plug to a profile at the bottom of the sub 10. The retrievable plug would be inserted through the bores 18 and 30 of the sub 10.

Figure 2:
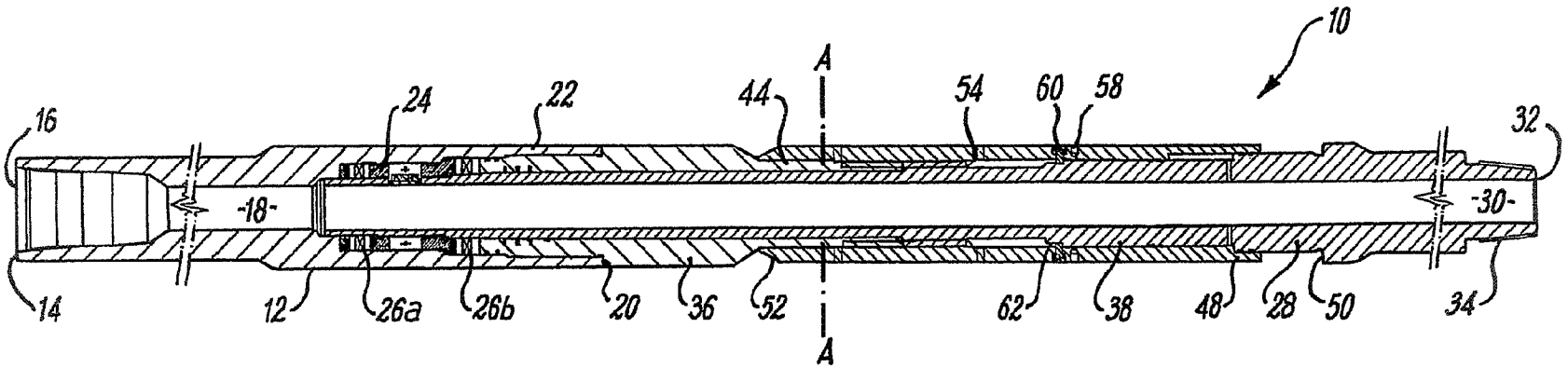
FIG. 2 is a cross-sectional view through the sub of FIG. 1 in a second, locked configuration.
Figure 4:
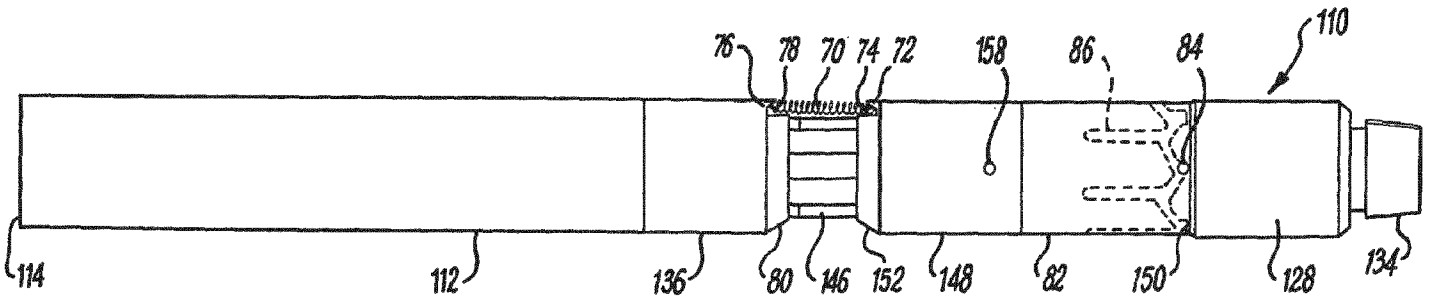
FIG. 4 is a schematic view of a swivel sub according a further embodiment of the present invention.

Reference is now made to FIG. 4 of the drawings which shows a swivel sub generally indicated by reference numeral 110, according to a further embodiment of the present invention. Like parts to those of the swivel sub 10 shown in FIGS. 1 to 3, have been given the same reference numeral with the addition of 100. The embodiment in FIG. 4 is similar to the swivel sub 10 of FIGS. 1 to 3, but comprises two additional features. The first of these is the incorporation of a spring 70 located between the sleeves 136 and 148. A first end 72 of spring 70 is located within a recess 74 in the upper face 152 of the sliding sleeve 148. An opposing end 76 of the spring 70 is located in a recess 78 within a portion 80 of a locking sleeve 136, behind the teeth 146.

In use, when the differential pressure increases sufficiently to shear the shear pin 158, the sleeve 148 will move over the sleeve 136 for the teeth 146, 156 to engage. As the sleeve 148 moves, the spring 70 is compressed. As long as the differential pressure is maintained, the sleeve 148 will remain over the teeth 146 and the sub 110 will rotate in its entirety. Release of the differential pressure will cause the sleeve 148 to drop so that it falls back to the abutment face 150. On reaching the abutment face 150, the sub 110 is now disengaged and the body 112 connected to the drill-pipe string can be rotated relative to the inner mandrel 128.

It will be appreciate that merely by varying the differential pressure across the sub 110, the sub 110 can be moved from the engaged to disengaged position any number of times. The sub 110 therefore has an advantage over the sub 10, in that it can be used repeatedly. However, the sub 10 has the advantage that it can be locked in either position.

A further feature which may be added to the sub 110 is the incorporation of an index sleeve 82. The index sleeve 82 forms a portion of the inner mandrel 128 and comprises a continuous groove 86 machined circumferentially around the outer surface 138 of the mandrel 128. Located on the inner surface 154 of the sliding sleeve 148 is a pin 84. Although only one pin is illustrated, it will be appreciated that a number of pins may be used to increase the stability of the sub 110 and distribute the loading on the sub 110 in use. Pin 84 locates in the groove 86. Groove 86 is a typical J-slot arrangement which is circumferentially arranged around the inner mandrel 128.

In use, the pin 84 is initially located in a first slot and by varying the differential pressure on the sub 110 and via the bias on the spring 70, the pin 84 is moved around the groove 86. It can be appreciated that the pin 84 may be arranged on the sleeve 48, while the groove 86 is arranged on the inner mandrel 128. The arrangement of the J-slots would then be repositioned accordingly.

The principal advantage of the present invention is that it provides a swivel sub which allows a workstring to be rotated above the sub, while a downhole apparatus, such as a screen, liner assembly, or drill bit below the sub is not affected by the rotation or torque.

A further advantage of the present invention is that it provides a swivel sub, wherein the rotational coupling can be selectively deployed so that, if necessary, the torque can be imparted through the sub.

A yet further advantage of the present invention is that it provides a swivel sub in which relative rotation between the workstring above and downhole apparatus, such as a screen, liner assembly, or drill bit below the sub, can be achieved without compression or tension at the sub.

It will be appreciated that while the terms 'upper' and 'lower' together with 'top' and 'bottom' have been used within this specification, they are relative terms and the sub could find equal application in deviated or horizontal wellbores.

Various modifications may be made to the invention herein described without departing from the scope thereof. For instance, although the change in differential pressure has been described by the action of a ball landing on a shearable ball seat or by running of a retrievable plug to a profile at the bottom of the sub, the movement of the sliding sleeve can also be effected by the application of hydraulics on the surface, or indeed by other mechanical means. Additionally, the embodiments described show a sub wherein the drill-pipe string can rotate relative to apparatus connected at the base of the sub during run-in, the sub could equally be set such that the sub is locked to provide through rotation during run-in, and then unlocked in a position in the wellbore. This feature may be suitable for the operation of hydraulic tools located at the base of the sub.

The invention claimed is:

1. A method of running a screen or liner into a wellbore, the method comprising the steps:

locating a swivel sub between a workstring and a liner or screen assembly;

rotating the workstring with the swivel sub in a first position, such that the workstring rotates while the liner or screen remains stationary;

running the workstring into the wellbore while rotating the workstring with the swivel sub in the first position;

creating a positive pressure differential in the swivel sub to switch the sub into a second position, such that the workstring and at least a portion of the liner or screen assembly rotate together; and rotating the workstring and the portion of the liner or screen assembly.

2. The method as claimed in claim 1, further including the step of locking the sub in the second position.

3. The method as claimed in claim 1 wherein the step of creating the positive pressure differential is repeated so that the sub is cycled between the first and second positions.

4. The method as claimed in claim 1 wherein the liner or screen assembly comprises a running or setting tool for the liner or screen.

5. The method as claimed in claim 1 further including the step of creating a further pressure differential to relocate the sub into the first position and rotating the workstring relative to the liner or screen assembly.

* * * * *